US006457798B1

(12) United States Patent
Drake

(10) Patent No.: US 6,457,798 B1
(45) Date of Patent: Oct. 1, 2002

(54) SIX GRAY LEVEL ROOFSHOOTER FLUID EJECTOR

(75) Inventor: Donald J. Drake, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/721,948

(22) Filed: Nov. 27, 2000

(51) Int. Cl.[7] ..... B41J 2/205
(52) U.S. Cl. ..... 347/15
(58) Field of Search ..... 347/41, 15, 12, 347/9, 47

(56) References Cited

U.S. PATENT DOCUMENTS 5,192,959 A 3/1993 Drake et al. ..... 347/42
5,208,605 A * 5/1993 Drake ..... 347/40
5,790,152 A * 8/1998 Harrington ..... 347/48

* cited by examiner

*Primary Examiner*—Thinh Nguyen
(74) *Attorney, Agent, or Firm*—Oliff & Berridge PLC

(57) ABSTRACT

An fluid ejector printer with a roofshooter structure wherein the fluid ejector printer includes a first array of nozzles with at least two heaters between the ink supply and the nozzle within each first array of nozzles and a second array of nozzles with at least two heaters between the fluid supply and the nozzle within each second array of nozzles wherein each array of nozzles can eject ink drops of at least two sizes onto a receiving medium during a single pass of a single point.

1 Claim, 6 Drawing Sheets

SIX GRAY LEVEL ROOFSHOOTER FLUID EJECTOR

BACKGROUND OF THE INVENTION

1. Field of Invention

This invention relates generally to a fluid ejector apparatus.

2. Description of Related Art

Fluid ejector systems, such as drop-on-demand liquid ink printers, such as piezoelectric, acoustic, phase change wax-based or thermal, have at least one fluid ejector from which droplets of fluid are ejected towards a receiving sheet. Within the fluid ejector, the fluid is contained in a plurality of channels. Power pulses cause the droplets of fluid to be expelled as required from orifices or nozzles at the end of the channels.

In a thermal fluid ejection system, the power pulse is usually produced by a heater transducer or resistor, typically associated with one of the channels. Each resistor is individually addressable to heat and vaporize fluid in one of the channels. As voltage is applied across a selected heater resistor, a vapor bubble grows in the associated channel and displaces ink from the channel, so that it is ejected from the channel orifice as a droplet. When the fluid droplet hits the receiving medium, the fluid droplet forms a dot or spot of fluid on the receiving medium. The channel is then refilled by capillary action, which, in turn, draws fluid from a supply container of fluid.

A fluid ejector system can include one or more thermal fluid ejector dies having a heater portion and a channel portion. The channel portion includes an array of fluid channels that bring fluid into contact with the resistive heaters, which are correspondingly arranged on the heater portion. In addition, the heater portion may also have integrated addressing electronics and driver transistors. Since the array of channels in a single die assembly is not sufficient to cover the length of a page, the fluid ejector is either scanned across the page with the receiving medium advanced between scans or multiple die assemblies are butted together to produce a full-width fluid ejector.

Because thermal fluid ejector nozzles typically produce spots or dots of a single size, high quality fluid ejection requires the fluid channels and corresponding heaters to be fabricated at a high resolution, such as, for example, on the order of 400–600 or more channels per inch.

When the fluid ejector is an ink jet printhead, the fluid ejector may be incorporated into for example, a carriage-type printer, a partial width array-type printer, or a page-width type printer. The carriage-type printer typically has a relatively small printhead containing the ink channels and nozzles. The printhead can be sealingly attached to a disposable ink supply cartridge. The combined printhead and cartridge assembly is attached to a carriage that is reciprocated to print one swath of information at a time, on a stationary receiving medium, such as paper or a transparency, where each swath of information is equal to the length of a column of nozzles.

After the swath is printed, the receiving medium is stepped a distance at most equal to the height of the printed swath so that the next printed swath is contiguous or overlaps with the previously printed swath. This procedure is repeated until the entire image is printed.

In contrast, the page-width printer includes a stationary printhead having a length sufficient to print across the width or length of the sheet of receiving medium. The receiving medium is continually moved past the page-width printhead in a direction substantially normal to the printhead length and at a constant or varying speed during the printing process. A page width fluid ejector printer is described, for instance, in U.S. Pat. No. 5,192,959, incorporated herein by reference in its entirety.

Fluid ejection systems typically eject fluid drops based on information received from an information output device, such as a personal computer. Typically, this received information is in the form of a raster, such as, for example a full page bitmap or in the form of an image written in a page description language. The raster includes a series of scan lines comprising bits representing individual information elements. Each scan line contains information sufficient to eject a single line of fluid droplets across the receiving medium a linear fashion. For example, fluid ejecting printers can print bitmap information as received or can print an image written in the page description language once it is converted to a bitmap of pixel information.

SUMMARY OF THE INVENTION

Thermal fluid ejection systems with two heaters per ink channel can eject different sized drops based on the operation of the two heaters. Thermal fluid ejection systems can also be incorporated into a dual array roofshooter structure. The dual array roofshooter structure can utilize two heaters per ink channel. As a voltage is applied across a selected resistor of a heater, a vapor bubble grows in the associated channel and displaces ink from the channel, so that is ejected from the channel orifice as a droplet When large sized drops are required, a drop is fired with both of the heaters operating in order to produce a large spot on the receiving medium. When a smaller sized drop is required, a drop is fired using only one of the two heaters. The larger spot creates a high productivity/low resolution pattern of the fluid droplets while the small drop produces a low productivity/high resolution pattern of the fluid droplets on the receiving medium.

Thermal fluid ejection systems with dual heaters per channel are limited, however, in their ability to create intermediate spots sizes between the largest spot size and ejecting no fluid at all. In particular, in this conventional roofshooter architecture, only three spot size levels can be obtained as only zero, one small, or one large drop can be ejected per nozzle per channel.

This invention provides a thermal fluid ejection systems with two heaters per channel while using a roofshooter structure with a dual array system to expand the spot size level capabilities.

In various exemplary embodiments of the fluid ejection systems and methods with a roofshooter structure according to this invention, the fluid ejection system includes a first array of channels with at least two heaters between the fluid supply and the end of each first array of channels and a second array of channels with at least two heaters between the fluid supply and the end of each second array of channels. Each array of channels can eject fluid drops of at least two sizes onto the receiving medium during a single pass past a single point. If the two channel arrays are aligned in the printing direction, then a given pixel on the page can receive either no drops, one small drop, two small drops, one large drop, one large drop and one small drop or two large drops during a sinlge pass, depending on how many heaters are activated in the two aligned drop ejectors.

These and other features and advantages of this invention are described and are apparent from the detailed description of various exemplary embodiments of the systems and methods according to this invention.

BRIEF DESCRIPTION OF THE DRAWINGS

Various exemplary embodiments of this invention will be described in detail with reference to the following figures, where like numerals represent like elements, and wherein.

DETAILED DESCRIPTION OF PREFERRED EMBODIMENTS

The following detailed description of various exemplary embodiments of the fluid ejection systems according to this invention are directed to one specific type of fluid ejection system, an ink jet printer, for sake of clarity and familiarity. However, it should be appreciated that the principles of this invention, as outlined and/or discussed below, can be equally applied to any known or later developed fluid ejection systems, beyond the ink jet printer specifically discussed herein.

Figure 1:
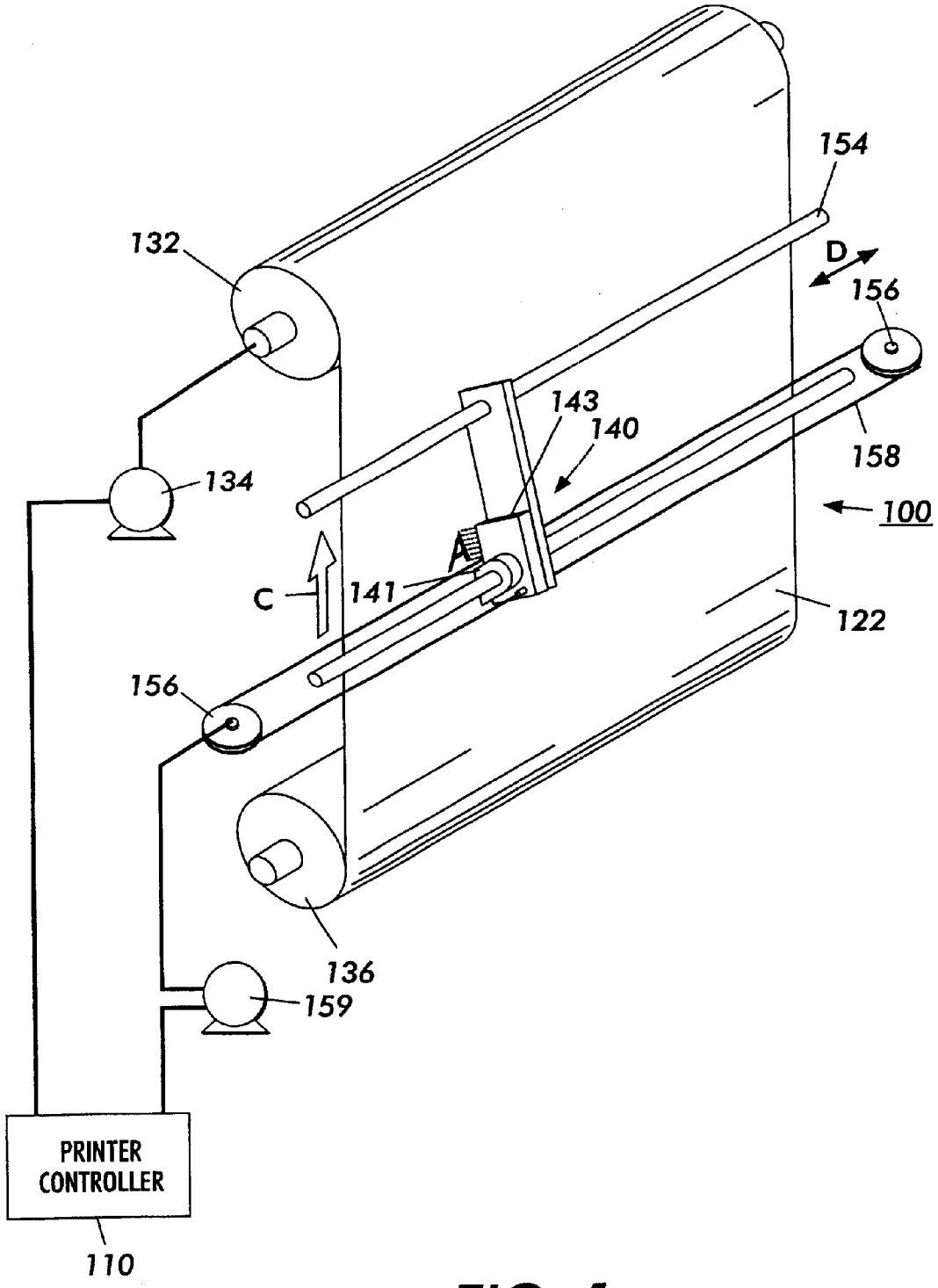
FIG. 1 is a schematic view of a printing system usable with fluid ejection printing systems and methods according to the invention.

FIG. 1 shows an exemplary carriage-type fluid ejector printing device 100. A linear array of droplet-producing channels is housed in one or more printheads 140 mounted on a reciprocal carriage assembly 143. The array extends along a slow scan, or process, direction C. In the exemplary carriage-type fluid ejector printing device 100 shown in FIG. 1, the one or more printheads 140 includes two or more printheads 140. Ink droplets 141 are propelled onto a receiving medium 122, such as a sheet of paper, that is stepped a preselected distance, at most equal to the size of the array, by a motor 134 in the process direction C each time the printhead 140 traverses across the receiving medium 122 along the swath axis D. The receiving medium 122 can be a continuous sheet stored on a supply roll 136 and stepped onto takeup roll 132 by the stepper motor 134, or can be continues or discrete sheets stored in and/or advanced using other structures, apparatuses or devices well known to those of skill in the art.

The carriage assembly 143 is fixedly mounted on a support base 152, which reciprocally moves along the swath axis D using any well known structure, apparatus or device, such as two parallel guide rails 154. A cable 158 and a pair of pulleys 156 can be used to reciprocally move the one or more printheads 140. One of the pulleys 156 can be powered by a reversible motor 159. The printheads 140 is generally moved across the recording medium 122 perpendicularly to the direction the recording member 122 is moved by the motor 134. Of course, other structures for reciprocating the carriage assembly 143 are possible.

The fluid ejector printing device 100 is operated under the control of a print controller 110. The print controller 110 transmits commands to the motors 134 and 159 and to the one or more printheads 140 to produce an image on the image recording medium 122. Furthermore, the printhead controller 110 can control the ejection of ink from the one or more printheads 140.

Figure 2:
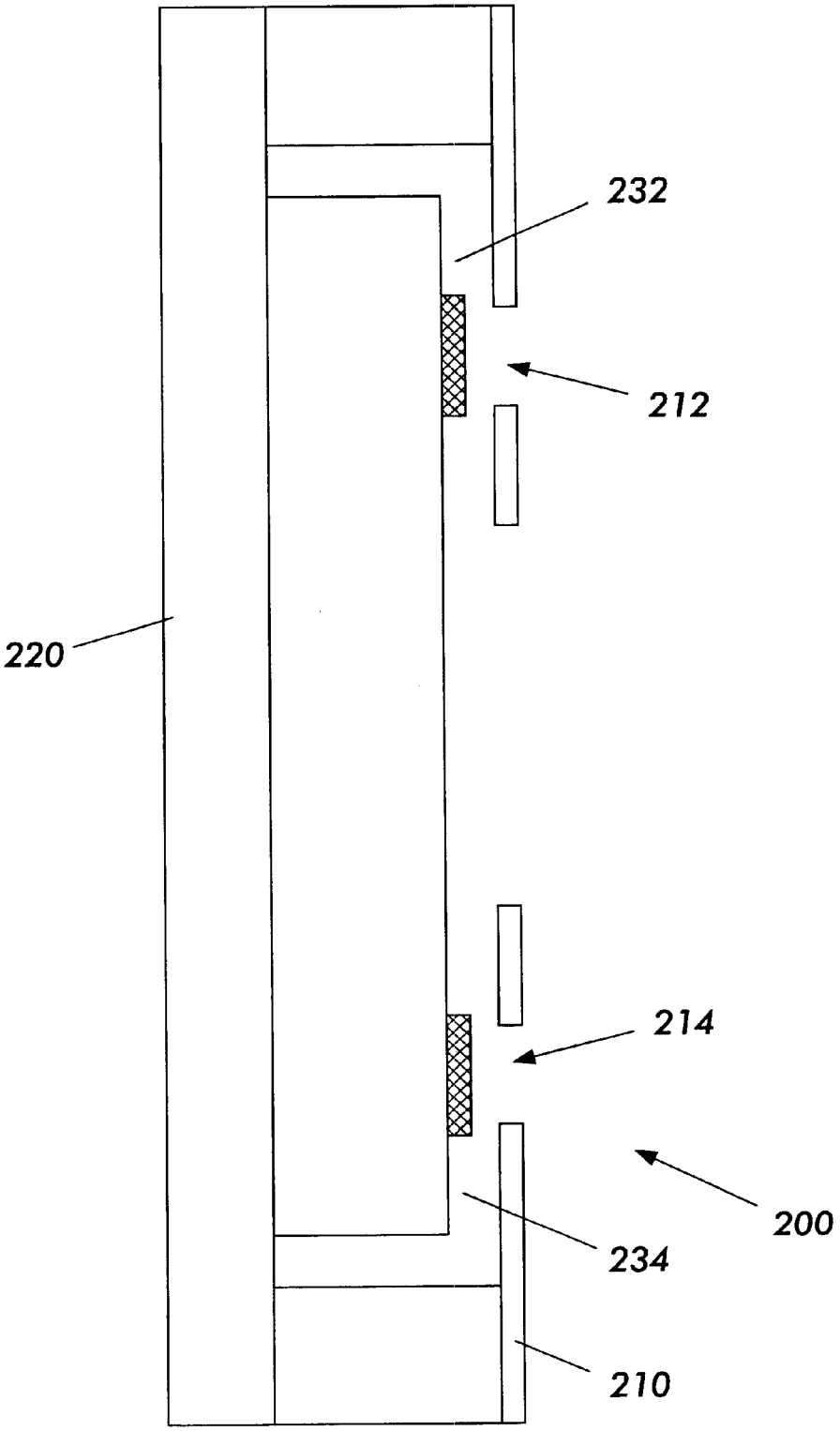
FIG. 2 is a cross section of a printing system with a roofshooter structure.
Figure 3:
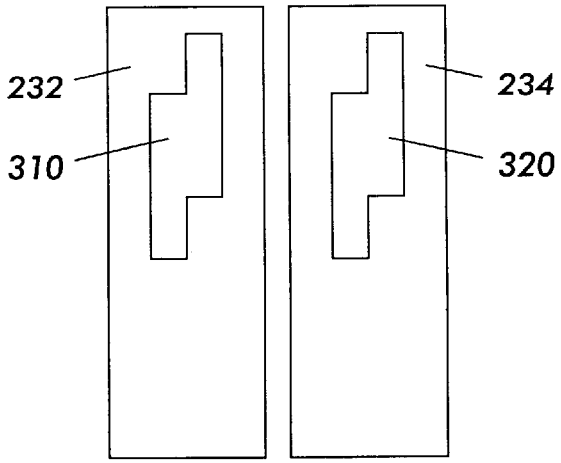
FIG. 3 is a cross section of a duel heater per channel.
Figure 4:
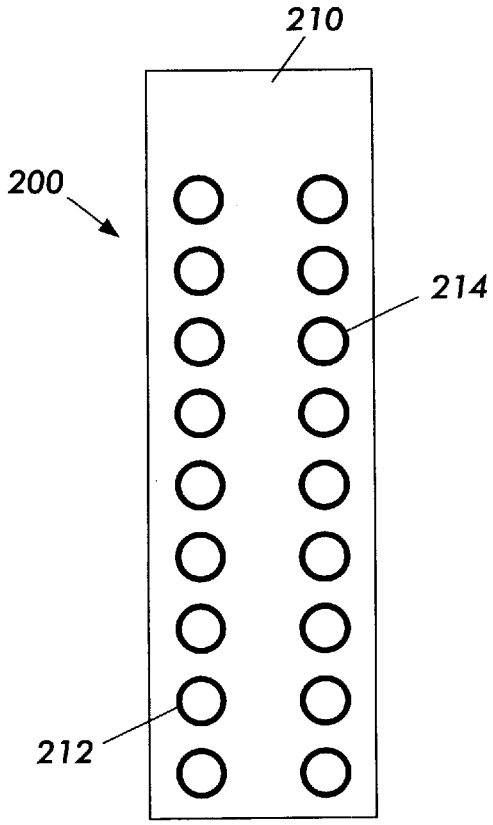
FIG. 4 is a plane view of a printing system with a roofshooter structure according to a first exemplary embodiment.

FIGS. 2–4 illustrate one exemplary embodiment of a fluid ejection system 200 having a roofshooter structure. The fluid ejection system 200 includes an array of nozzles 212 and 214, and an ink supply path 220. As shown in FIG. 3, a dual heater 310 is located within the first channel 232 and a dual heater 320 is located within the second channel 234.

As shown in FIG. 2, in various exemplary embodiments, the fluid ejection system includes two arrays of nozzles 212 and 214 formed in a nozzle face. An ink channel 232 and 234 connects the printhead nozzles 212 and 214, respectively, with the ink supply path 220. As a voltage is applied across a selected one of the dual heaters 310 or 320, a vapor bubble grows in the ink channel 232 or 234. This causes the ejection of a small drop since only one of the dual heaters was energized. In order to create a large drop per nozzle 212 or 214, a voltage is applied across the dual heater 310 of the ink channel 232 or the dual heater 320 of the ink channel 234. Two vapor bubbles grow in the ink channel 232 or 234. Because the total bubble volume is larger when both heaters are energized compared to when one is energized, more ink is displaced in the channel and a larger drop is ejected, compared to the ejected drop size when only one heater is energized. As should be appreciated, the total bubble volume is more than twice the size of the total bubble volume when both heaters are energized compared to when one heater of a dual heater 310 or 320 is energized. However, the voltage applied across both of the heaters of a dual heater 310 or 320 or the nozzle diameter can be adjusted to reduce the total bubble volume created by both of the dual heaters 310 and 320

As can be appreciated, the number of heaters energized in each channel 232 and 234 can be varied to adjust the gray tone densities on the receiving medium 122. In the first exemplary embodiment shown in FIGS. 2 and 3, the array of nozzles 212 and 214 are aligned across the nozzle face 210 so that the combination of the two arrays of nozzles can produce a spot of five different sizes on a single pixel location on the receiving medium 122 to create any one of six gray levels.

Figure 5:
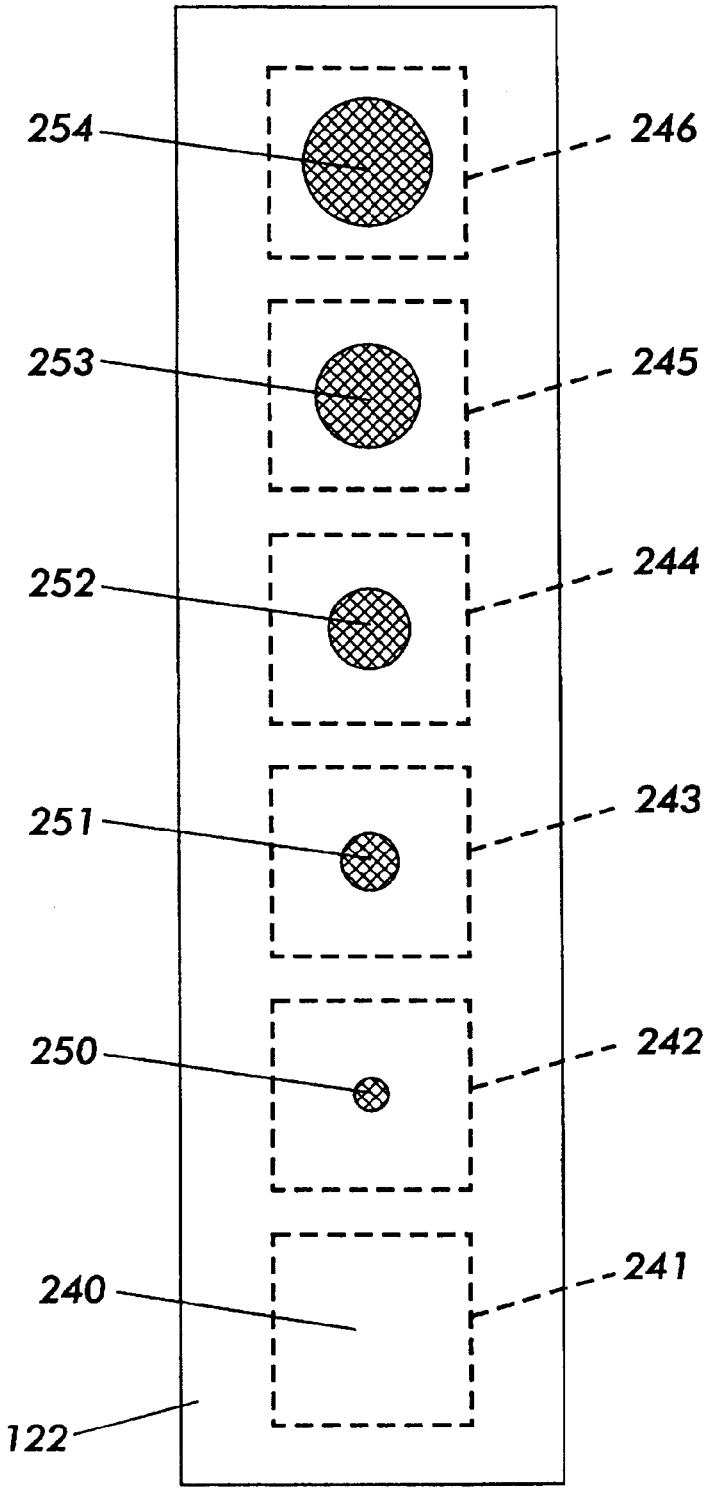
FIG. 5 is a plane view of various gray tones printed by the printing system according to the first exemplary embodiment.

As shown in FIG. 5, for each fixed location 240 of the receiving medium 122, zero, 1 or 2, drops can be ejected onto that pixel location 240, and each drop can be either large or small. FIG. 5 shows 6 pixel locations 240. In a first pixel location 241, zero ink drops are provided in that pixel location 240 to form a first gray level. In a second pixel location 242, only a single small ink spot 250 is provided in that pixel location 240, thus forming a second gray level. It should be appreciated that, to form this second gray level, either one of the nozzles 212 or one of the nozzles 214 from the array of nozzles 212 and 214 could be used to eject a single small drop of ink onto the receiving medium 122 to form the single small ink spot 250.

In a third pixel location 243, two single small spots are provided to form a spot 251 in that pixel location 240, thus forming a third gray level. It should be appreciated that, to form this third gray level, both of the nozzles 212 and 214 from the array of nozzles 212 and 214 each eject a single small drop of ink onto the receiving medium 122 to form the spot 251.

In a fourth pixel location 244, only a single large ink spot 252 is provided in that pixel location 240, thus forming a fourth gray level. It should be appreciated that, to form this fourth gray level, either one of the nozzles 212 or 214 from the array of nozzles 212 and 214 could be used to eject a single large drop of ink onto the receiving medium 122 to form the single large spot 252.

In a fifth pixel location 244, both a single small spot and a single large spot are provided to form a spot 253, thus forming a fifth gray level. It should appreciated that, to form this fifth gray level, either one of the nozzles 212 or 214 from the array of nozzles 212 and 214 eject a single small drop of ink onto the receiving medium 122 while the other one of the nozzles 212 or 214 from the array of nozzles 212 and 214 eject a single large drop of ink onto the receiving medium 122 to form the spot 253.

In a sixth pixel location 246, two single large spots are provided to form a spot 254 in that pixel location 240, thus forming a sixth gray level. It should be appreciated that, to form this sixth gray level, both of the nozzles 212 and 214 from the array of nozzles 212 and 214 each eject a single large drop of ink onto the receiving medium 122 to form the spot 254.

Figure 6:
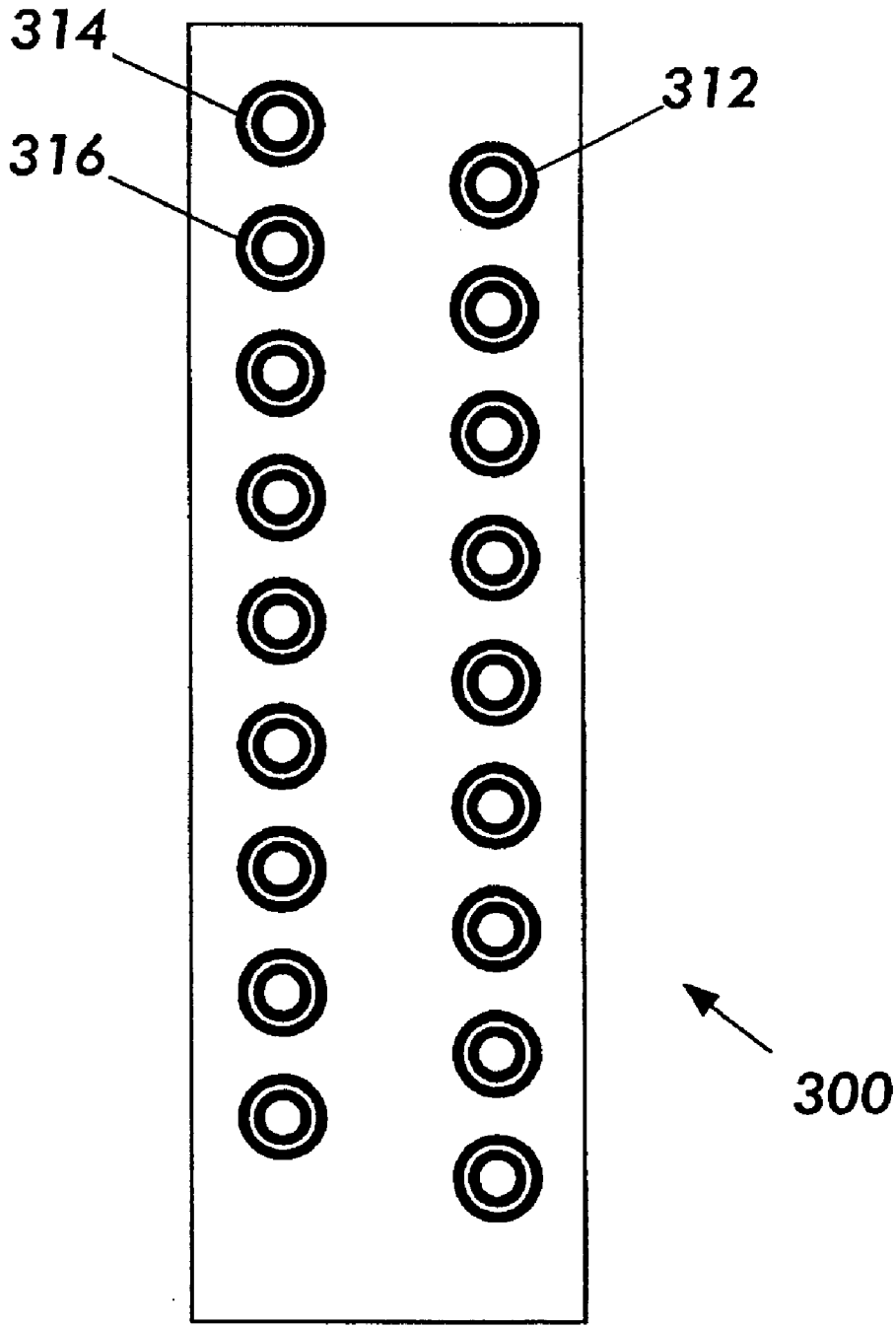
FIG. 6 is a plane view of a printing system with a roofshooter structure according to a second exemplary embodiments.

FIG. 6 shows a second exemplary embodiment of a nozzle face 310. As shown the array of nozzles 312 and 314 are staggered on the nozzle face 310 are staggered. As should be appreciated, when a first drop of ink is ejected from a nozzle 312 from the array of the nozzles 312 onto the receiving medium 122 for a particular pixel, a second drop of ink is ejected from a nozzle 314 or 316 from the other array of nozzles 314 and 316 which overlaps the first drop. As should be appreciated, either nozzle 314 or 316 can be used as nozzle 312 is located between nozzle 314 and 316. Thus, the two arrays of nozzles can produce a spot of five different sizes on a single pixel location on the receiving medium 122 to create any one of six gray levels.

Figure 7:
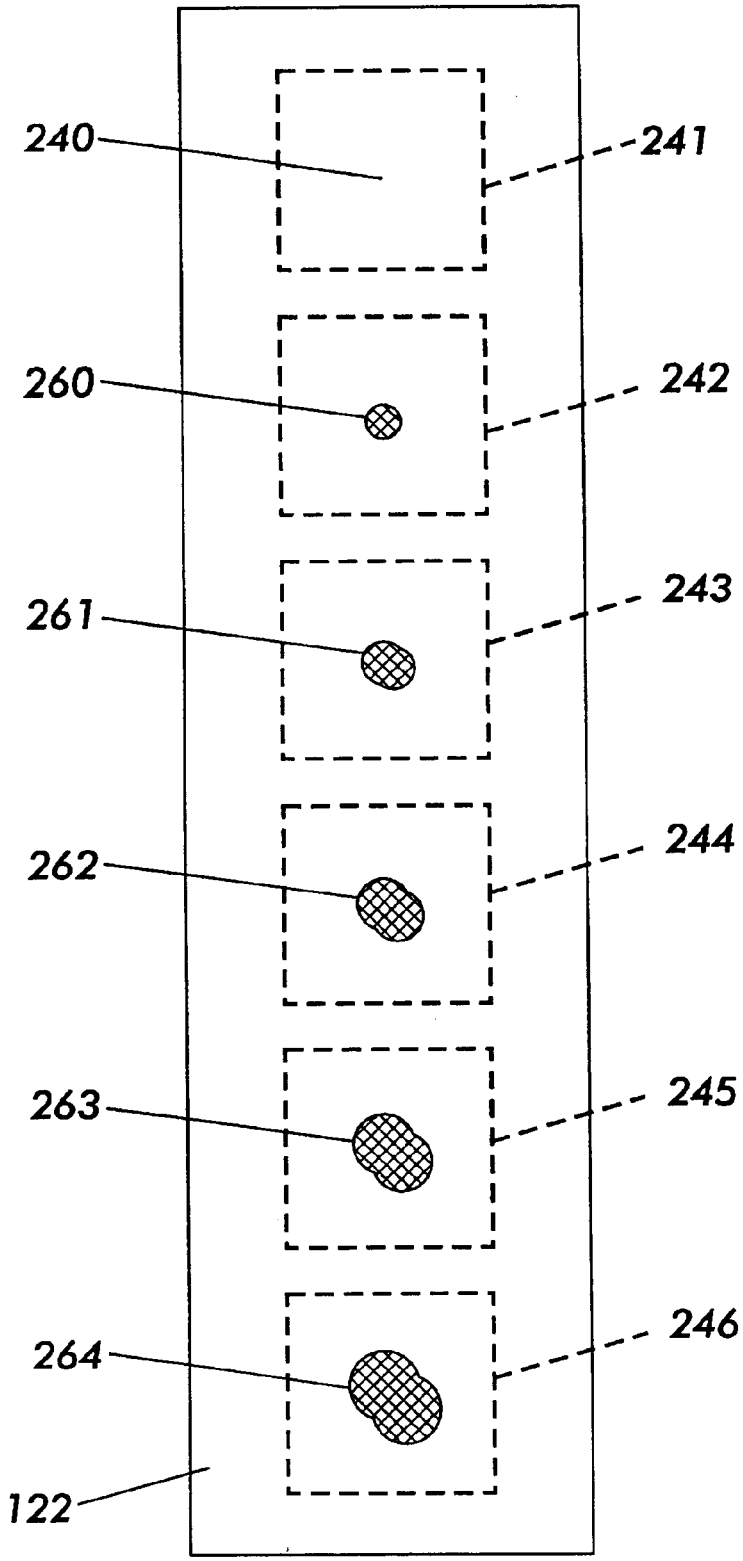
FIG. 7 is a plane view of various gray tones printed by the printing system according to the second exemplary embodiment.

As shown in FIG. 7, for each fixed location 240 of the receiving medium 122, zero, 1 or 2, drops can be ejected onto that pixel location 240, and each drop can be either large or small. FIG. 7 shows 6 pixel locations 240. In a first pixel location 241, zero ink drops are provided in that pixel location 240 to form a first gray level. In a second pixel location 242, only a single small ink spot 260 is provided in that pixel location 240, thus forming a second gray level. It should be appreciated that, to form this second gray level, either one of the nozzles 212 or one of the nozzles 214 from the array of nozzles 212 and 214 could be used to eject a single small drop of ink onto the receiving medium 122 to form the single small ink spot 260.

In a third pixel location 243, two single small spots are provided to form a spot 261 in that pixel location 240, thus forming a third gray level. It should be appreciated that, to form this third gray level, both of the nozzles 212 and 214 from the array of nozzles 212 and 214 each eject a single small drop of ink onto the receiving medium 122 to form the spot 261.

In a fourth pixel location 244, only a single large ink spot 252 is provided in that pixel location 240, thus forming a fourth gray level. It should be appreciated that, to form this fourth gray level, either one of the nozzles 212 or 214 from the array of nozzles 212 and 214 could be used to eject a single large drop of ink onto the receiving medium 122 to form the single large spot 262.

In a fifth pixel location 244, both a single small spot and a single large spot are provided to form a spot 263, thus forming a fifth gray level. It should appreciated that, to form this fifth gray level, either one of the nozzles 212 or 214 from the array of nozzles 212 and 214 eject a single small drop of ink onto the receiving medium 122 while the other one of the nozzles 212 or 214 from the array of nozzles 212 and 214 eject a single large drop of ink onto the receiving medium 122 to form the spot 263.

In a sixth pixel location 246, two single large spots are provided to form a spot 264 in that pixel location 240, thus forming a sixth gray level. It should be appreciated that, to form this sixth gray level, both of the nozzles 212 and 214 from the array of nozzles 212 and 214 each eject a single large drop of ink onto the receiving medium 122 to form the spot 264.

While this invention has been described in conjunction with the exemplary embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. A fluid ejection system having a roofshooter structure, comprising:

a first array of nozzles, each nozzle associated with at least two heaters to eject a first ink drop of at least two sizes with a first size smaller than a second size; and a second array of nozzles, each nozzle associated with at least two heaters to eject a second ink drop of at least two sizes with a third size smaller than a fourth size, wherein a first ink level on a single pixel of the receiving medium is created when no ink drops are ejected, a second ink level is created on a single pixel of the receiving medium when either the first size or the third size is ejected, a third ink level is created on a single pixel of the receiving medium when both the first size and the third size is ejected, a fourth ink level is created on a single pixel of the receiving medium when either the second size or the fourth size is ejected, a fifth ink level is created on a single pixel of the receiving medium when either the first size or the third size and either the second size or the fourth size is ejected and a sixth ink level is created on a single pixel of the receiving medium when both the second size and the fourth size is ejected.

* * * * *